US006682623B1

(12) United States Patent
Biagiotti

(10) Patent No.: US 6,682,623 B1
(45) Date of Patent: Jan. 27, 2004

(54) DEVICE FOR GLUING ROLLS OF WEB MATERIAL AND ASSOCIATED METHOD

(75) Inventor: Guglielmo Biagiotti, Capannori Lucca (IT)

(73) Assignee: Fabio Perini S.p.A., Lucca (IL)

( * ) Notice: Subject to any disclaimer, the term of this patent is extended or adjusted under 35 U.S.C. 154(b) by 0 days.

(21) Appl. No.: 09/937,318

(22) PCT Filed: Apr. 10, 2000

(86) PCT No.: PCT/IT00/00134

§ 371 (c)(1),
(2), (4) Date: Sep. 25, 2001

(87) PCT Pub. No.: WO00/63099

PCT Pub. Date: Oct. 26, 2000

(30) Foreign Application Priority Data

Apr. 16, 1999 (IT) ..... FI99A0089

(51) Int. Cl.[7] ..... B65H 81/00; B32B 31/00

(52) U.S. Cl. ..... 156/187; 156/191; 156/444; 156/450

(58) Field of Search ..... 156/187, 184, 156/191, 444, 450

(56) References Cited

U.S. PATENT DOCUMENTS

| | | | | |
|---|---|---|---|---|
| 3,044,532 A | * | 7/1962 | Ghisoni | 156/361 |
| 3,393,105 A | | 7/1968 | Tellier | |
| 4,299,642 A | * | 11/1981 | Berkholtz | 156/191 |
| 4,693,766 A | * | 9/1987 | Stauffer | 156/191 |
| 5,679,206 A | * | 10/1997 | Glass | 156/184 |
| 5,681,421 A | | 10/1997 | Biagiotti | |
| 5,716,489 A | | 2/1998 | Biagiotti | |
| 5,759,326 A | | 6/1998 | Vigneau | |
| 6,372,064 B1 | * | 4/2002 | Butterworth et al. | 156/187 |

FOREIGN PATENT DOCUMENTS

| | | | |
|---|---|---|---|
| EP | 0 742 169 A2 | | 11/1996 |
| EP | 0 742 169 A3 | | 11/1997 |
| FR | 474198 | | 2/1915 |
| GB | 1 495 445 | | 12/1977 |
| GB | 2047208 A | * | 11/1980 |
| GB | 2061234 A | * | 5/1981 |
| GB | 2 098 092 A | | 11/1982 |
| JP | 50-35562 | | 11/1975 |

* cited by examiner

*Primary Examiner*—Jeff H. Aftergut
(74) *Attorney, Agent, or Firm*—Breiner & Breiner, L.L.C.

(57) ABSTRACT

The device comprises: a feed path for a roll to be glued; along said path a station for unwinding and positioning the tail edge of the roll; in said unwinding and positioning station, a first movable member (7) and a second movable member (9) make contact with said roll (R). A glue dispenser comprising a glue reservoir (53) and a dispensing element (55) movable along a dispensing path is also provided.

31 Claims, 9 Drawing Sheets

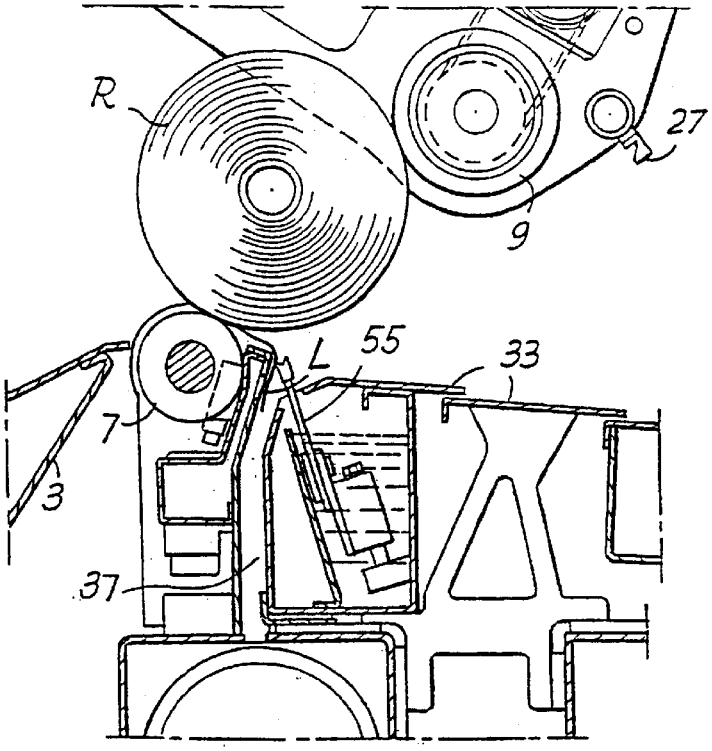
Fig.10
Fig.11
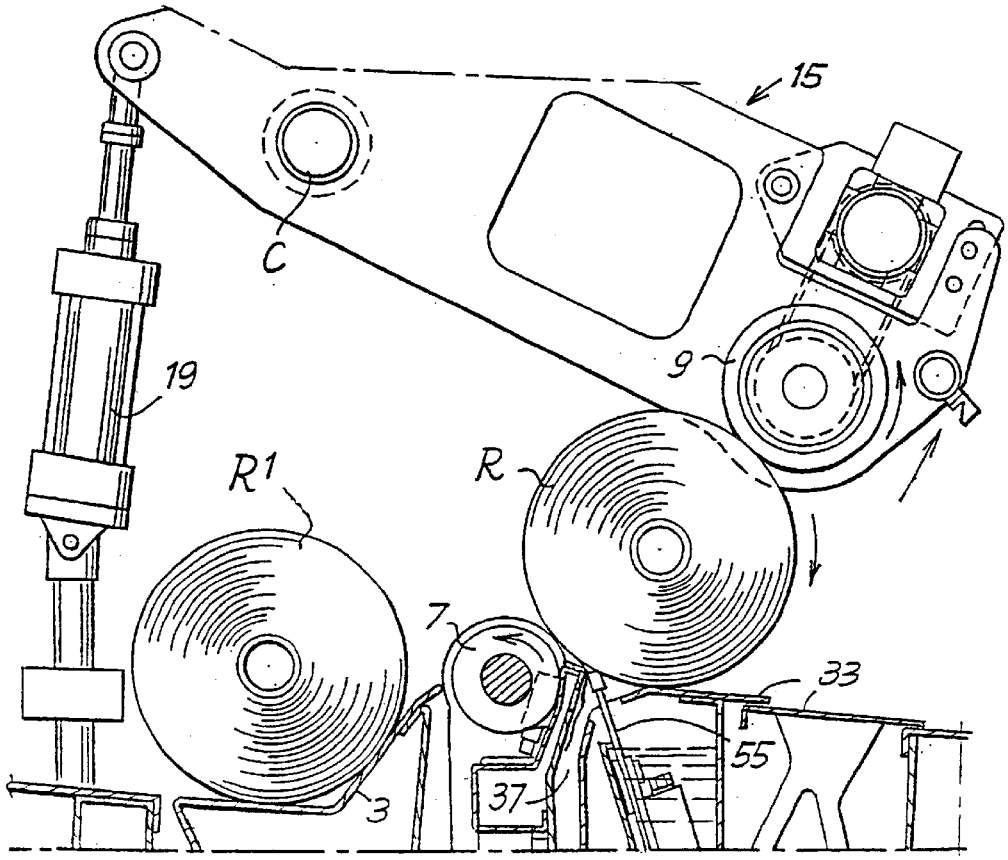

DEVICE FOR GLUING ROLLS OF WEB MATERIAL AND ASSOCIATED METHOD

TECHNICAL FIELD

The present invention relates to a device for gluing the tail edge of web material wound in roll form, for example a roll of paper, toilet paper, all-purpose drying paper and the like. The invention also relates to a method for gluing the tail edge of rolls of wound web material.

STATE OF THE ART

In the paper converting industry, for example for the production of rolls of toilet paper, all-purpose drying paper, printing paper and the like, rolls or so-called "logs" of web material are frequently produced from large-diameter reels supplied from the paper mill. The rolls or logs are formed in rewinding machines and are then unloaded toward a gluing device which applies glue between the tail edge of the web material and the surface of the roll so as to cause the tail edge to adhere to said roll. The roll is then conveyed towards other processing stations, in particular towards a cutting machine which cuts the roll into small rolls of smaller length, destined for packaging and for sale.

U.S. Pat. No. 5,681,421 describes a gluing device comprising a roll feed path which has, along it, a station in which positioning of the free tail edge of the web material is performed so as to be able to perform subsequent gluing. In the positioning station the log is brought into contact with two movable members consisting, for example, of a roller and a belt. By controlling the movement of these members, the roll is temporarily stopped in the positioning station and the tail edge of the web material is sucked into a cavity or recess located underneath the roll feed path. Downstream of the positioning station there is a dispenser which, in one of the embodiments described, has a movable element which removes glue from a tank and conveys it up to a height of a surface for rolling of the roll, in correspondence of a slit.

By controlling the speed of the movable members making contact with the roll in the positioning station, said roll is fed towards the glue dispensing slit and, rolling over it, receives the glue on a portion of the roll surface, for example along a generatrix. By continuing the rolling movement, the tail edge is made to adhere to the surface of the roll where the glue has been applied.

EP-A-0742169 describes a substantially identical gluing method in which the positioning station is provided with two rollers located at a distance from each other and forming the movable members making contact with the roll. The movement of these two rollers is controlled so as to perform correct positioning of the free tail edge and the subsequent unloading of the roll onto an inclined surface where it receives the glue in the manner described above.

In these known devices and methods the glue is applied onto the external surface of the roll after raising and partially unwinding the tail edge.

In certain cases, however, the glue must be applied onto the tail edge instead of onto the material which is still wound. This requirement may arise depending on the type of material to be glued and, in particular, when the web material consists of a twin ply of very absorbent paper. When applying glue onto the surface of the roll insufficient gluing of the tail edge may occur since only the innermost ply of the tail edge adheres to the roll surface. In addition to this, an excessive amount of glue may be absorbed by the inner wound turns of web material. In other cases, if the material is not very absorbent and has two (or more) plies, it may be necessary to apply the glue with a certain pressure in order to cause it to seep through to the second ply, i.e. the outermost ply.

JP-5035562 describes a gluing device and method in which the roll to be glued is positioned on a pair of rotating rollers defining a cradle on which the roll is retained and made to rotate by rotation of the two rollers. The two rollers have, arranged underneath them, a glue dispenser which, in one of the embodiments described, is in the form of a movable bar which conveys the glue upwards from an underlying reservoir. The bar is brought into contact with the roll resting on the two rollers, after stopping rotation of the roll in a suitable angular position with the tail edge arranged between the two rollers. When gluing has been completed, the roll is wound up and expelled from the cradle formed by the two rollers, by means of a thruster.

In this known device gluing is also performed by necessarily applying the glue onto the roll surface instead of onto the tail edge. Moreover, in this device the gluing times are particularly long.

When the rolls to be glued have a large diameter, in devices where sealing of the tail edge is performed by means of rolling there may be the drawback that an excessively long rolling path is required in order to obtain winding-up of the tail edge and application of a gluing pressure onto the zone which has received the glue.

OBJECTS OF THE INVENTION

A first object of the present invention is to provide a device and a method for gluing, i.e. sealing, the tail edge of rolls of web material, by means of which even large-diameter rolls may be easily glued.

In particular, within the scope of this general object, the invention aims to provide a device and a method in which it is possible to glue the tail edge of large-diameter rolls without the need for lengthening excessively the roll feed path.

Moreover, an object of the invention is to provide a device and a method which may be adapted in an easy and efficient manner, also in terms of production speed, for the processing also of rolls having a greatly variable diameter.

According to another aspect of the present invention, the object of the invention is to provide a method and a device which allow rapid and reliable gluing also in the case where the glue must be applied onto the tail edge instead of onto the roll surface, while maintaining the possibility of performing gluing by means of application of the glue onto the roll surface, should this be required.

The object of an improved embodiment of the invention is to provide a device which allows gluing of the rolls by applying the glue either onto the external surface of the roll or onto the internal surface of the tail edge of the web material.

SUMMARY OF THE INVENTION

These and further objects and advantages, which will become clear to persons skilled in the art from a reading of the text which follows, are obtained by means of an improvement to the gluing device of the type comprising: a path for feeding of the roll to be glued; a station for unwinding and positioning the tail edge along the feed path; in the unwinding and positioning station, a first movable member and a second movable member which make contact with the roll during positioning of the tail edge and which define the position in which unwinding and positioning of the edge is performed; a glue dispenser with a reservoir and a dispensing element movable along a dispensing path, which is immersed in the glue and emerges from the glue so as to apply glue onto the web material.

According to a first aspect of the invention in a device of this type it is envisaged that the dispensing path along which the movable dispensing element moves, as well as the first and the second movable members in the positioning station, are arranged so that the dispensing path intersects the surface of the roll when the latter is in the condition where it is positioned in contact with the first and the second movable members of the positioning and unwinding station.

As will emerge clearly from the detailed description below of an example of embodiment, as a result of this arrangement, it is possible to dispense the glue (by means of the movable dispensing element) onto the surface of the roll, retaining the latter between the first and the second movable members, and then expel the roll from the positioning and unwinding station, causing it to pass between the two movable members. Sealing of the tail edge may be achieved in this case either by means of rolling along a rolling path downstream of the positioning station or by temporarily keeping the roll in the positioning station in contact with the two movable members, the movement of the latter causing the roll to rotate about its axis.

In order to obtain suitable positioning of the roll so as to simplify the path which must be followed by the movable dispensing element, the first and the second movable members of the positioning and unwinding station will be preferably arranged close to each other. Consequently, in order to allow subsequent feeding of the roll and unloading thereof from the positioning station, the first and the second members of the positioning station are movable relative to one other so as to move away from each other cyclically whenever a roll passes through.

The first and/or the second movable member may be preferably constructed as motorized rollers, even though it is possible for one or both of them to be constructed differently, for example in the form of continuous flexible members such as belts or the like.

In order to allow the movement away from each other of the first and the second movable members, the second of said members may be mounted on an oscillating arm advantageously equipped with a weight balancing means, for example a spring, in particular an air spring or the like.

The dispensing path followed by the movable dispensing element is preferably at least partly a rectilinear path. It is preferably inclined with respect to the vertical and oriented towards the station for positioning of the tail edge.

According to a particularly advantageous embodiment of the invention, the roll feed path, downstream of the first movable member of the positioning station, is provided (in a manner known per se) with a suction recess arranged underneath the feed path and having an axis mouth inside which the tail edge of the web material is sucked. In this case means may be provided for arranging, in the vicinity of the access mouth of the suction recess, a section bar for supporting the tail edge of the roll. This section bar extends so as to intersect the dispensing path of the movable dispensing element. In this way, when it is required to apply the glue onto the internal surface of the free edge instead of onto the external surface of the roll, the supporting section bar may be arranged in its operating position so that the free edge rests on It. The movement of the movable dispensing element in this case applies the glue onto the internal surface of the tail edge. "Internal surface" is understood as meaning that surface which, during winding-up, adheres onto the surface of the roll.

Where the device is provided with a suction recess, the first movable member of the positioning station will be advantageously arranged upstream of the suction recess with respect to the direction of feeding of the rolls, whereas the second movable member will extend preferably downstream of the suction recess. Where the second movable member consists of a roller, it will preferably be located downstream of the suction recess. If the second movable member consists of a continuous belt, it may be arranged entirely downstream of the suction recess or partially upstream and partially downstream thereof.

The suction recess may comprise two suction systems which are independent from one another and respectively arranged on the bottom of the recess and on a side wall thereof so as to facilitate the operations of positioning and retention of the tail edge during application of the glue, preventing the vacuum which is produced from sucking in the glue.

According to another aspect, the invention also relates to a device for gluing the tail edge of a roll of wound web material, comprising: a feed path for said roll; along said path a station for unwinding and positioning the tail edge of the roll; in said unwinding and positioning station, movable members making contact with said roll so as to unwind and position the free edge; a glue dispenser comprising a glue reservoir and a dispensing element which is movable along a dispensing path and which is immersed in said glue and, moving upwards, dispenses glue for gluing of the tail edge. In a characteristic manner the device comprises a support section bar on which the tail edge of the roll rests, said dispensing path intercepting said section bar so as to apply the glue onto the surface of the tail edge which, by means of subsequent winding-up, comes into contact with the roll surface. It is thus possible to glue rolls which require the application of a glue on the internal surface of the free edge. In particular, it is advantageously envisaged that the section bar may be removable so that said device may be also used for gluing rolls where the glue may be applied onto the external surface of the roll instead of onto the free edge. According to this further aspect of the invention, the dispensing element need not follow a path which intersects the surface of the roll which is located in the unwinding and positioning station, although this is advantageous and preferable, so as to provide a machine which is able to glue rolls using three different operating methods, as will emerge clearly from the description below.

Further advantageous features of the gluing device and methods according to the invention are described in the accompanying claims.

BRIEF DESCRIPTION OF THE DRAWINGS

The invention will be fully understood with reference to the description and the accompanying drawings which show practical non-limiting embodiments of the invention. More particularly:

FIGS. 8 to 11 show successive gluing stages in a second embodiment;

DETAILED DESCRIPTION OF THE PREFERRED EMBODIMENT OF THE INVENTION

Figure 1:
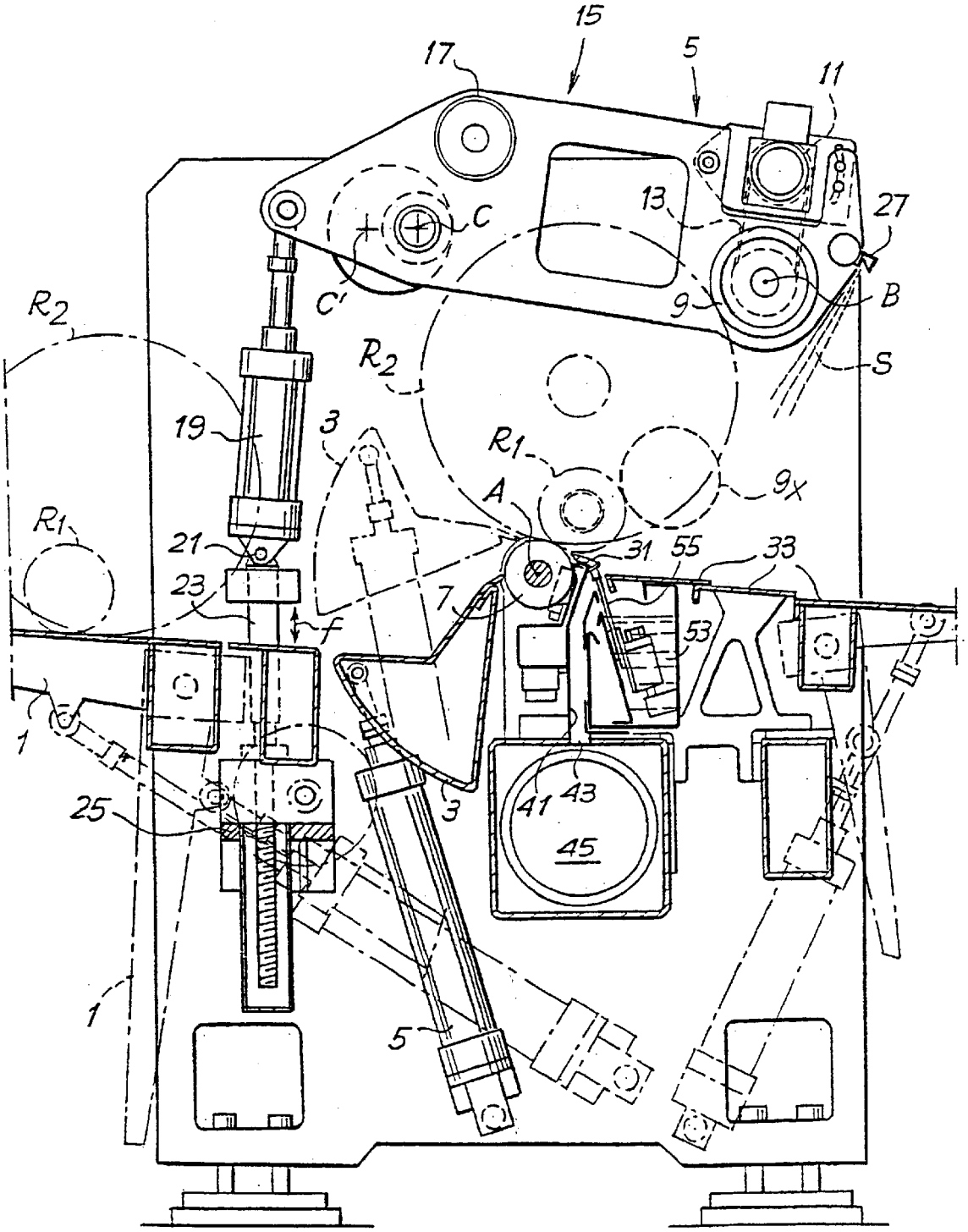
FIG. 1 shows a side view of the device.

With initial reference to FIGS. 1 and 1A, the device in its complete configuration will be described while the possible gluing processes which may be performed with this device are described in the following figures.

1 denotes an entry slideway onto which the rolls or logs supplied from a store or a rewinding machine arranged upstream of the gluing device are rolled. R1 and R2 denote, by way of example, two rolls of varying diameter which may be glued using the device. The rolls which are unloaded onto the slideway 1 are positioned onto a distribution device 3 having, associated with it, a cylinder/piston actuator 5 which causes oscillation thereof about an axis A. FIG. 1 shows in solid lines and in broken lines two positions of the distribution device 3: the first one in which a roll may be received by the distribution device 3, and second one in which the roll is unloaded into a station for positioning the tail edge, denoted generally by 5.

The positioning station 5 comprises a first movable member consisting of a roller 7 rotatable about the axis A by means of a drive system not shown. The positioning station 5 is also provided with a second movable member consisting of a second roller 9 rotating about an axis B. 11 denotes a motor which, by means of a belt 13, causes rotation of the roller 9. The roller 9 and the motor 11 are mounted on an oscillating group 15 essentially consisting of a pair of arms hinged about an oscillating axis C. The arms are connected together by a torsion bar 17. 19 denotes a cylinder/piston system forming an air spring which has a function of counter-balancing the weight of the roller 9 and the motor 11. The cylinder of the cylinder/piston system 19 is hinged at 21 with a rod 23 vertically movable in the direction of the arrow f23 by means of an electromechanical jack 25. The jack 25 has the function of adjusting the position of the hinging point 21 and therefore essentially the angular working position of the oscillating group 15.

The rollers 7 and 9 form two movable members which have the function of rotating the roll so as to obtain positioning of the tail edge prior to gluing and so as to unload the roll after gluing, as will be described in greater detail below.

Figure 1A:
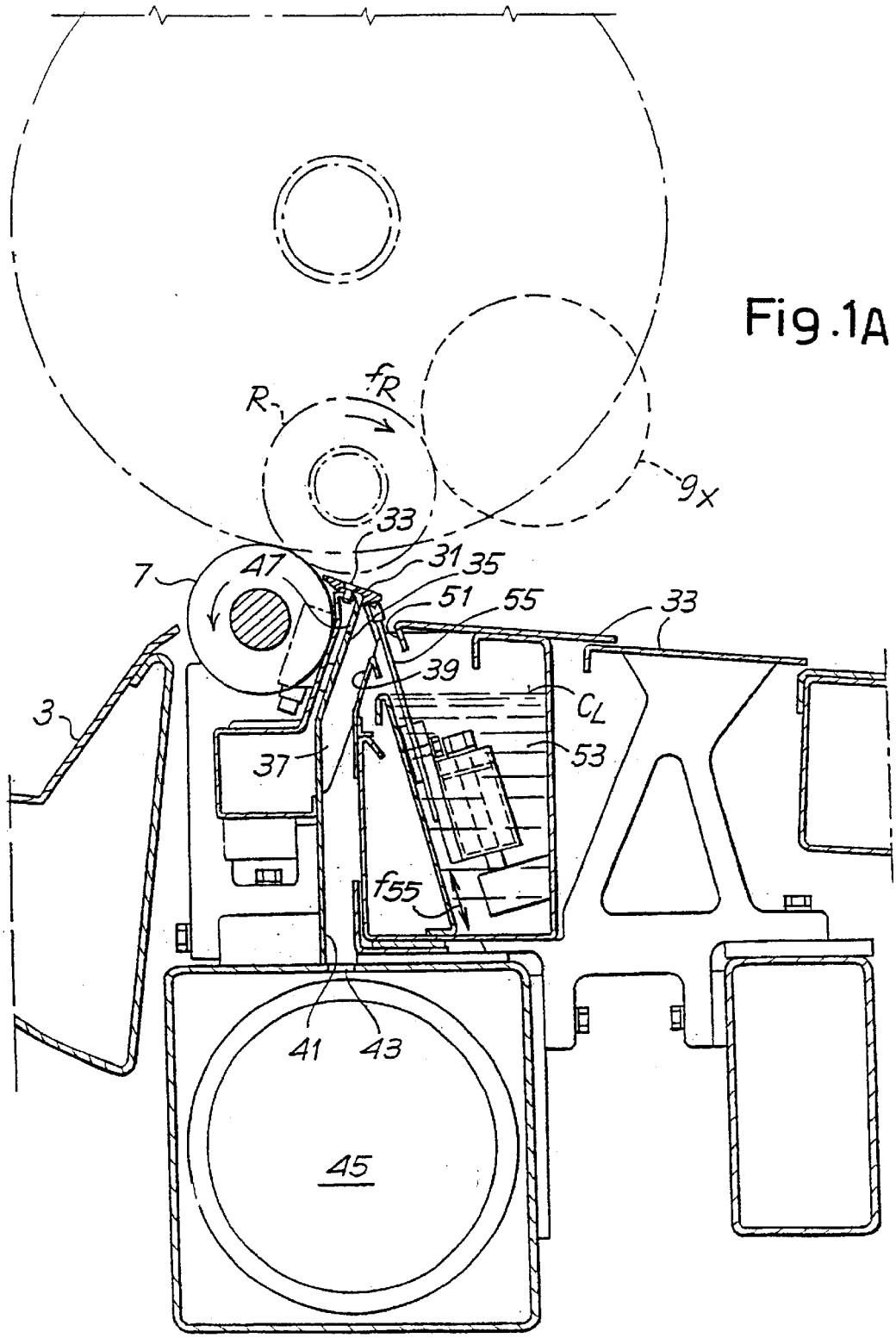
FIG. 1A shows an enlarged detail of FIG. 1.

As schematically shown in FIG. 1, rolls with a greatly varying diameter may be supplied into the positioning station 5. The position of the oscillating group 15 and the roller 9 shown in solid lines in FIG. 1 corresponds to the position assumed when the rolls to be glued have a large diameter. 9X indicates in broken lines the position which the roller 9 assumes when the rolls with a small diameter are processed. When passing from one diameter to another, the jack 25 is used in order to adjust the position of the hinging point 21, if necessary. If there is a significant variation in the diameter of the rolls, the hinging point of the oscillating group 15 may if necessary be varied so as to pass from the position indicated by C to the position C'.

The oscillating group 15 comprises a series of blowing nozzles 27 which are directed downwards and produce air jets S.

Downstream of the roller 7 there extends a path for feeding of the roll along rolling surfaces formed by a section bar 31 and by a slideway 33 which, in the example illustrated, consists of three successive portions. The section bar 31 is fixed by means of screws 33 to a support 35 which also defines a first wall of a suction recess 37. The latter is bounded by a second side wall 39 and by a bottom wall 41. Suction holes 43 connected to a suction chamber 45 are formed in the bottom wall 41. The wall 35 is provided with small suction holes 47 which are also connected to a vacuum source 46 independently from the suction chamber 45.

The suction recess 37 has a first upper section inclined with respect to the vertical and having an access mouth which emerges on the feed path of the roll R. The section bar 31 projects into the access mouth of the suction recess 37.

Opposite the section bar 31, in correspondence of the access mouth of the suction recess 37, there is an opening 51 which connects externally a reservoir 53 filled with glue up to a level CL. A movable dispensing element 55, performing an alternating movement in the direction of the double arrow f55, is arranged inside the reservoir 53. With this movement the dispensing element 55 moves along a dispensing path—rectilinear in the example shown—inclined with respect to the vertical and converging towards the access mouth of the suction recess 37. The section bar 31 intersects the dispensing path of the dispensing element 55. The dispensing element 55 may consist of a bar, a wire, a plate or the like. The movement may be achieved by means of any type of mechanism, for example a series of rocker arms, a traction member which pulls the dispensing element in a direction perpendicular to the plane of the figure, while said element is attached to the fixed structure by means of a system of pins, rollers or wheels engaging in inclined eyelets formed in the dispensing element 55 so that the latter is raised as it moves perpendicularly with respect to the figure, or the like.

The section bar 31 may be removed from its position by unscrewing the screws 33. When the section bar 31 is not present, the dispensing element 55 may perform a movement along the dispensing path until it comes into contact with the surface of the roll which is located in the positioning station in contact with the rollers 7 and 9. Conversely, the dispensing element 55 may be brought into an intermediate position between the position where it rests against the section bar 31 and the position where it makes contact with the surface of the roll R in the positioning station.

Unwinding and positioning of the free edge of the roll which is located in the positioning station 5 occurs substantially in the same manner described in U.S. Pat. No. 5,681,421. Greater details as to the procedures for positioning of the free edge will be provided in the description of the operating modes of the device.

The section bar 31, which as will be explained below allows the device to operate in a manner different from that of the traditional device, could be alternately mounted on a movable support system designed to bring the section bar alternately into a working position, corresponding to that shown in FIGS. 1 and 1A, and into a displaced position, where it does not interfere with the path of the dispensing element 55.

Figure 2:
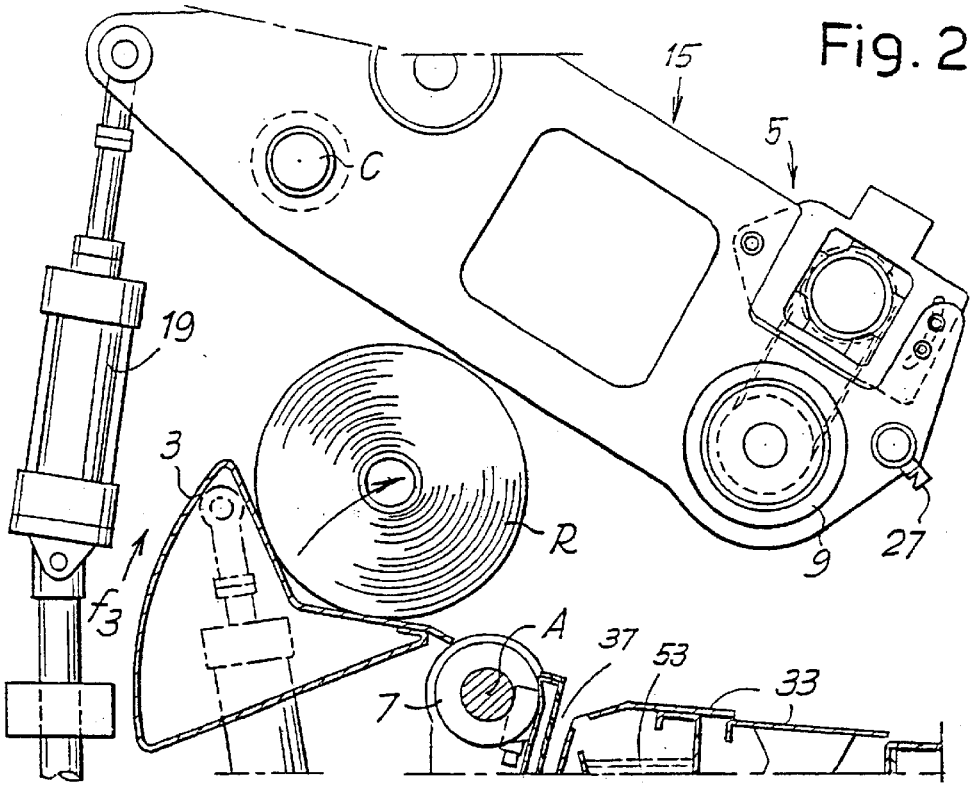
FIGS. 2 to 7 shows successive gluing stages in a first embodiment.

With reference to FIGS. 2 to 7, a first operating mode in which gluing of the tail edge is performed, while keeping the roll in the positioning station, will now be described. In FIG. 2 a roll to be glued R is located on the distribution device 3 which is made to oscillate about the axis A in the direction of the arrow f3 until it unloads the roll into the positioning station 5.

Figure 3:
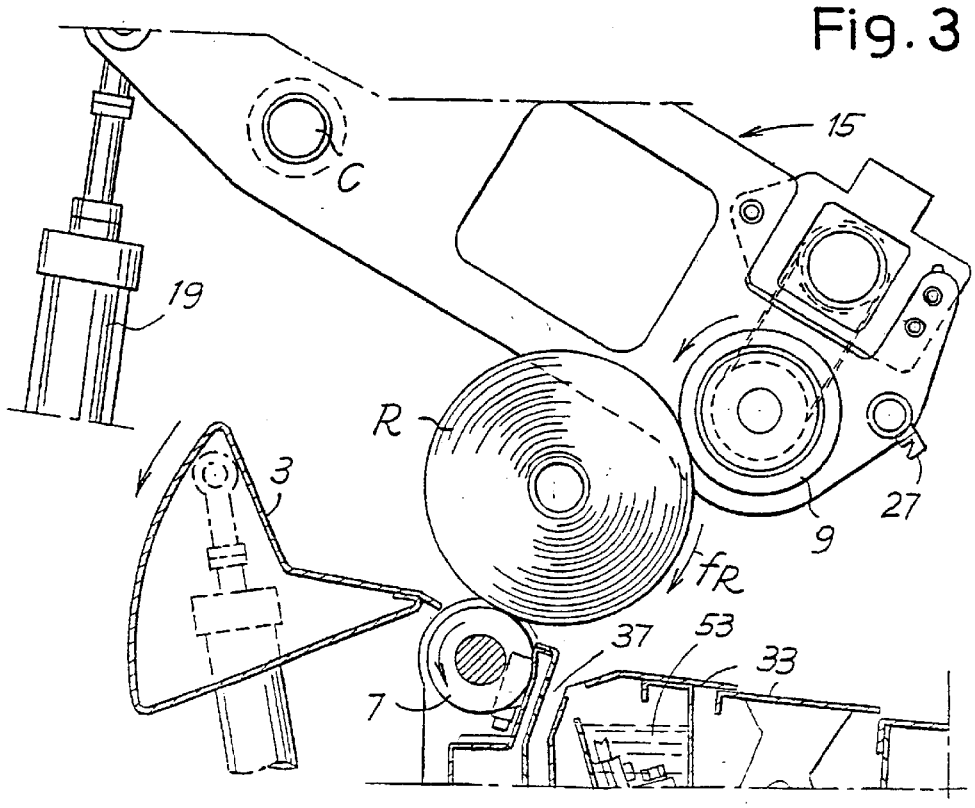
Figure 4:
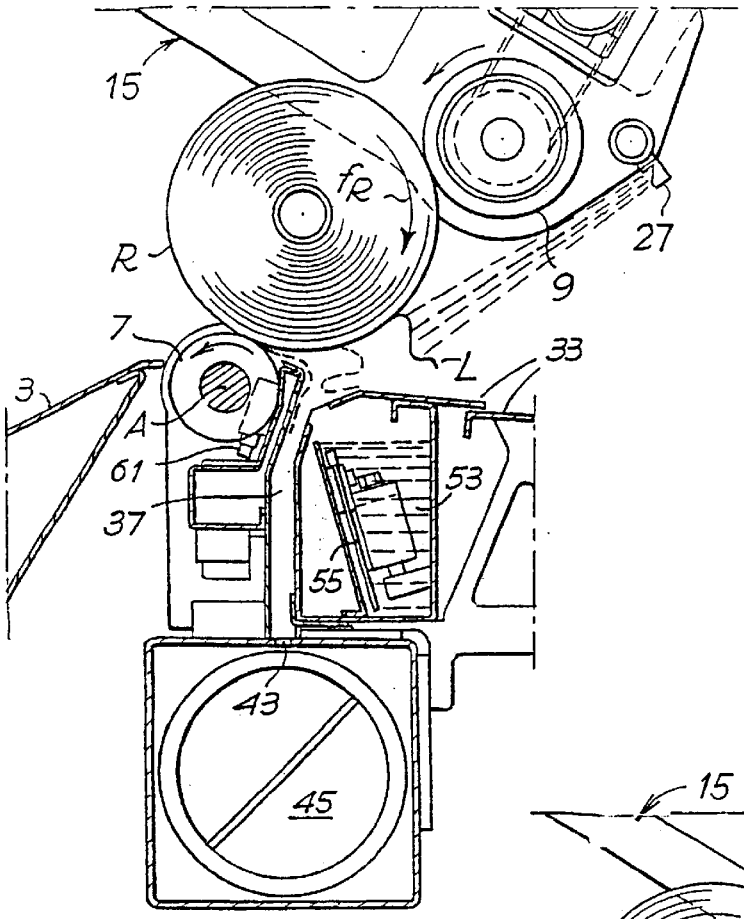
Figure 5:
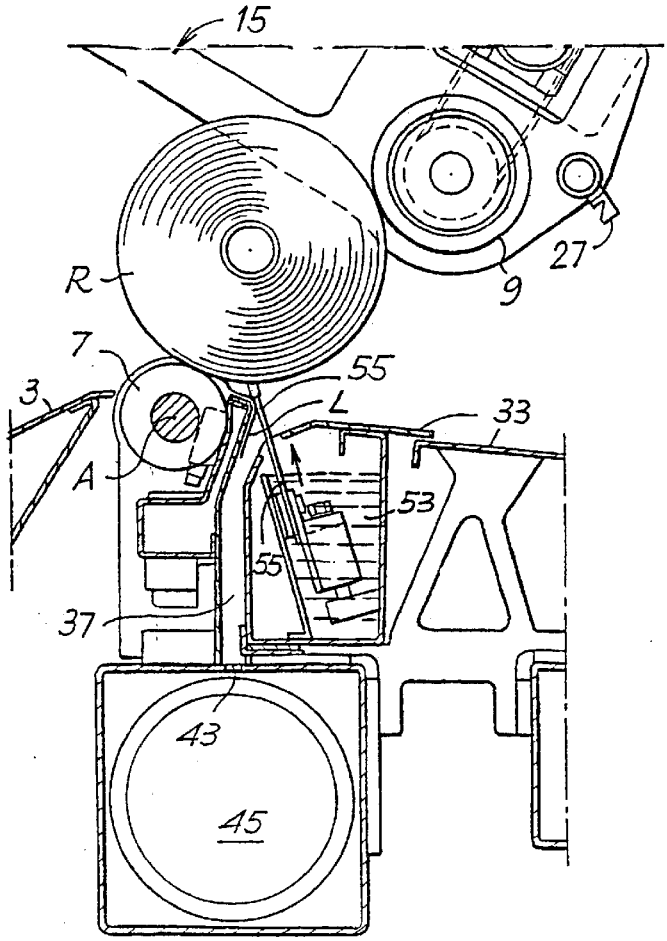

Here said roll is in contact with the rollers 7 and 9 in the position shown in FIG. 3. The roll is retained in the position shown in FIG. 3, while the rollers 7 and 9 are rotated. The peripheral speeds of the rollers 7 and 9 are identical to each other so that the roll R rotates about its axis, which remains stationary. The rollers 7 and 9 rotate in an anti-clockwise direction, as indicated by the arrows in FIGS. 3 and 4, such that the roll R rotates about its axis in a clockwise direction, i.e. in the winding direction, in the direction of the arrow fR. Then, the tail edge L is brought opposite the nozzles 27 and in front of the access mouth of the suction recess 37, as shown in FIG. 4. Inside the suction recess 37, during this step, a vacuum is created by means of suction from the holes 43 on the bottom of said recess. The sucking action inside the suction recess 37 and the jets produced by the nozzles 27 ensure that the tail edge L is inserted into the suction recess 37, extending along the length thereof as a result of the sucking action.

With continued rotation of the roll R, the tail edge L is gradually wound up until it reaches a predetermined position inside the suction recess 37, detected by a photocell 61. When the photocell is exposed by the tail edge L, it emits a signal which stops rotation of the rollers 7 and 9. The roll R with its tail edge L partially unwound and positioned is in the condition shown in FIG. 5. In this condition, the sucking action via the holes 43 is interrupted, while the sucking action through the holes 47 remains active, so that the tail edge L continues to adhere to the wall 35 of the suction recess 37.

The movable dispensing element 55 is then raised until it comes into contact with the external cylindrical surface of the roll R, where the glue removed from the reservoir 53 by the movable element itself is applied.

Figure 6:
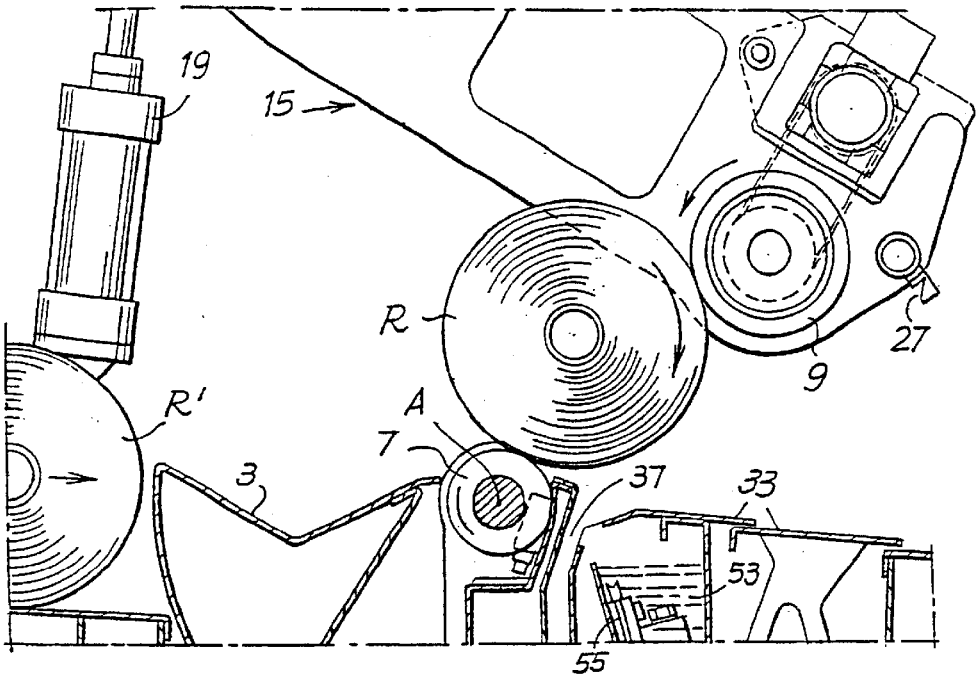

Once the glue has been transferred onto the cylindrical surface of the roll R, the movable dispensing element 55 is retracted and the rollers 7 and 9 are again made to rotate at the same peripheral speed so as to rotate the roll R about its axis (which remains stationary) until sealing of the tail edge L occurs, said edge being pressed onto the external surface of the roll R onto which the glue has been applied as a result of the pressure exerted between the roll and the roller 7 (see FIG. 6).

Figure 7:
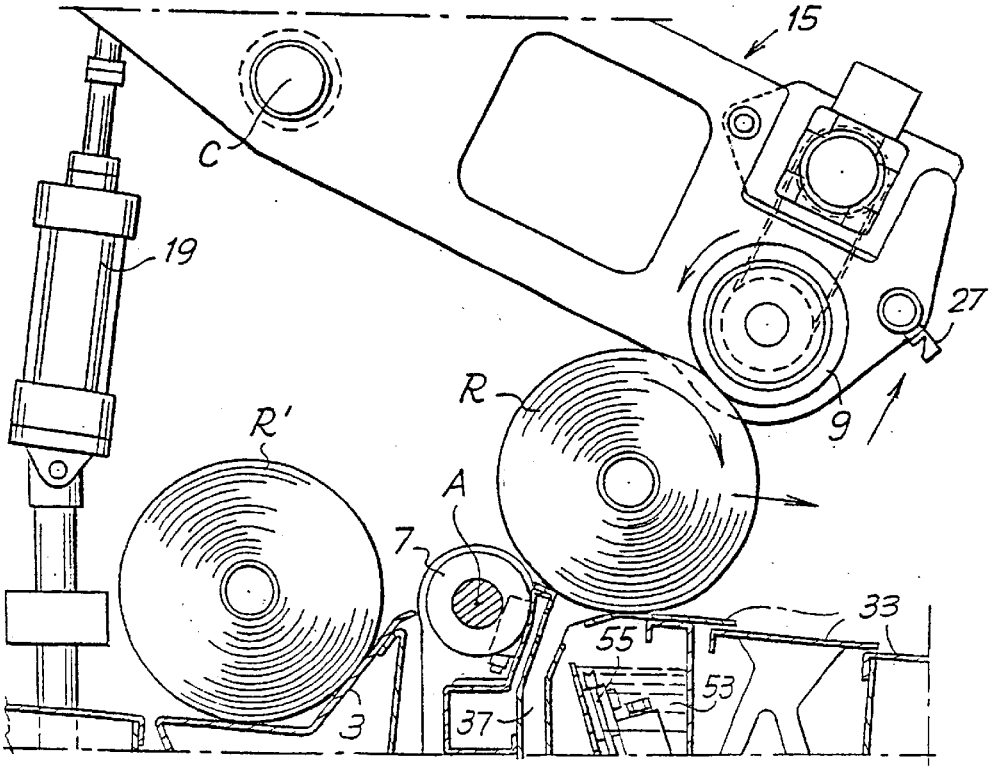

Once winding of the free end L has been completed, the speed of rotation of the rollers 7 and 9 is modified so that the peripheral speed of the roller 9 is greater than the peripheral speed of the roller 7. Actually, it can be envisaged that the roller 7 is stopped, while the roller 9 continues to rotate at the same speed. This causes a rolling movement of the roll R on the slideway 33, as shown in FIG. 7. During this step, the same rotation of the roller 9 and the roll R and the feeding movement of the latter along the slideway 33 cause raising of the oscillating group 15 so as to allow the roll R to pass through. Winding and sealing of the tail edge may be performed wholly or partly by means of rolling of the roll R along the unloading surface, instead of between the rollers 7 and 9. For this purpose, it is sufficient to vary the timing of the drive systems for the rollers 7 and 9.

Figure 8:
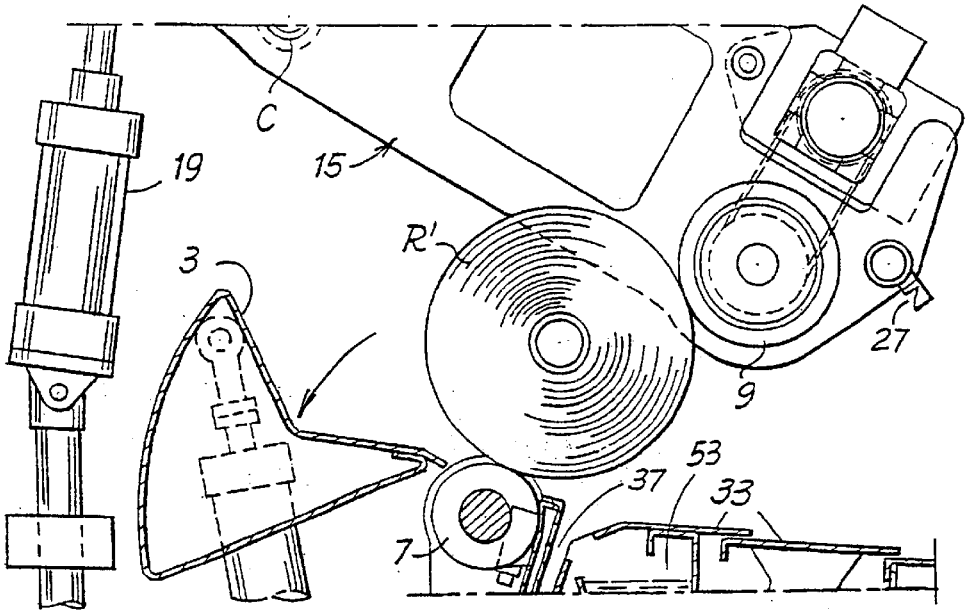

In the meantime a new roll R' has been positioned on the distribution device 3 (FIG. 8) and undergoes the same gluing operations.

Figure 9:
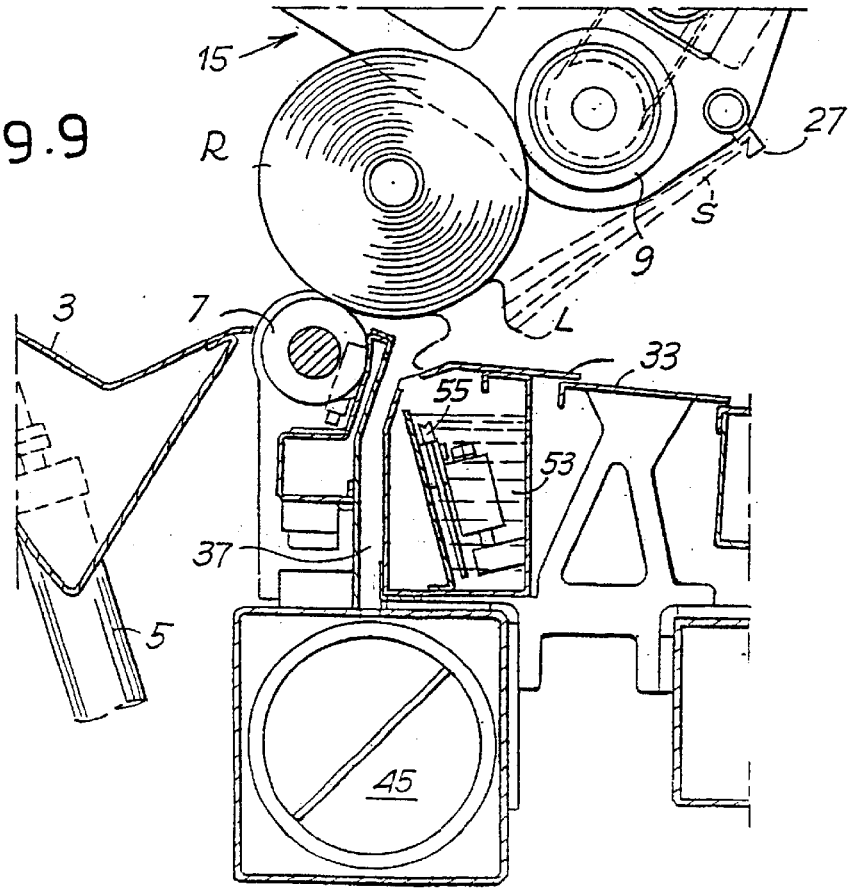

FIGS. 9, 10 and 11 show three successive steps of a different operating mode of the device, in which gluing is performed by rotating the roll R on the movable dispensing element 55 which has been brought into an intermediate position. More particularly, FIG. 9 shows the step involving positioning of the tail edge L, similar to that shown in FIGS. 4 and 5. FIG. 10 shows the condition where the tail edge is positioned and the movable dispensing element 55 has been brought in front of the access mouth of the suction recess 37. During the next step (FIG. 11) the roll R is made to roll on the slideway 33 and with its cylindrical surface comes into contact with the movable dispensing element 55, receiving glue from the latter. This operating mode is the same as that of the known gluing devices and may be used for small-diameter rolls where it is required to reduce the process time as far as possible.

Figure 12:
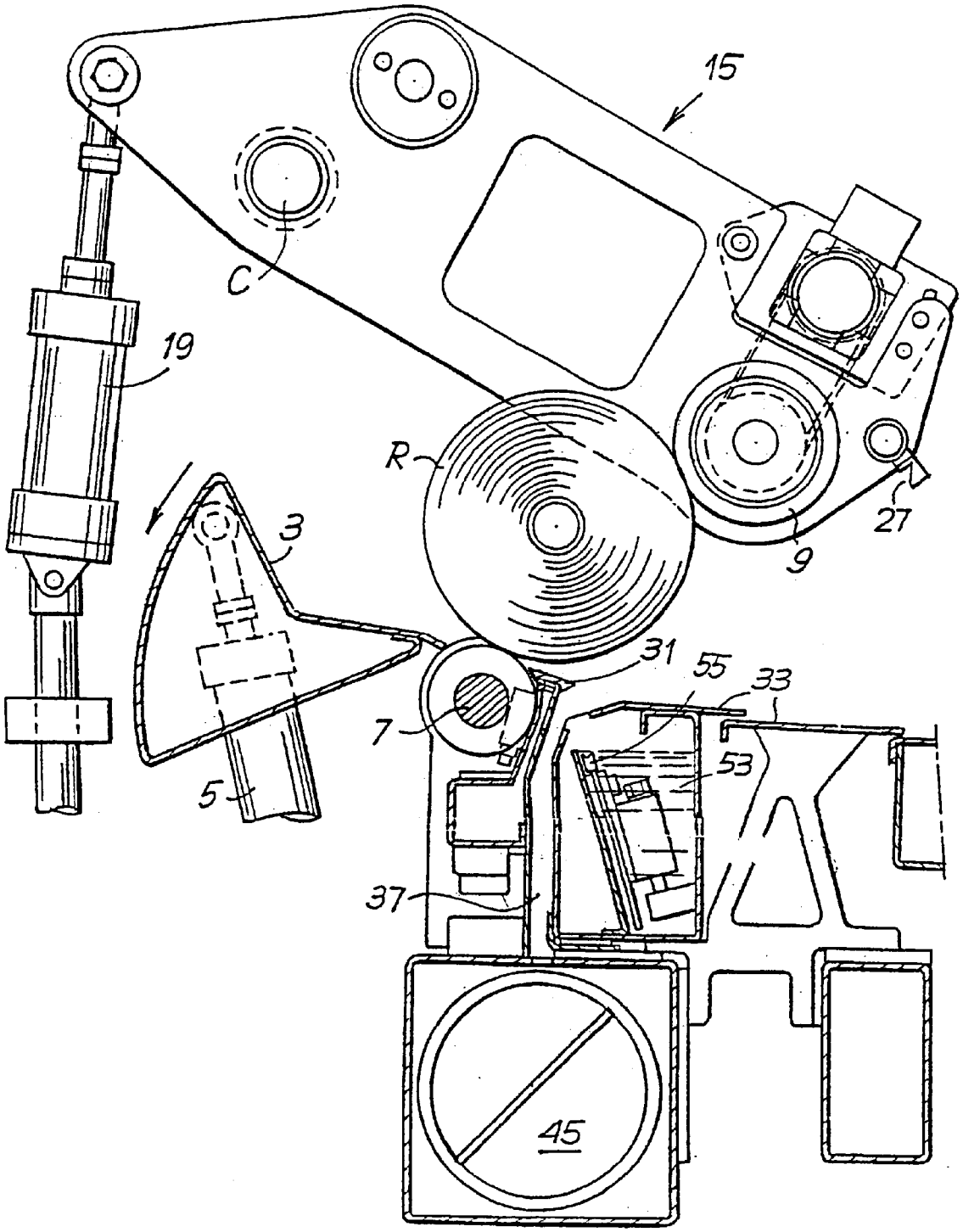
FIGS. 12 to 14 show successive gluing stages in a third embodiment.
Figure 13:
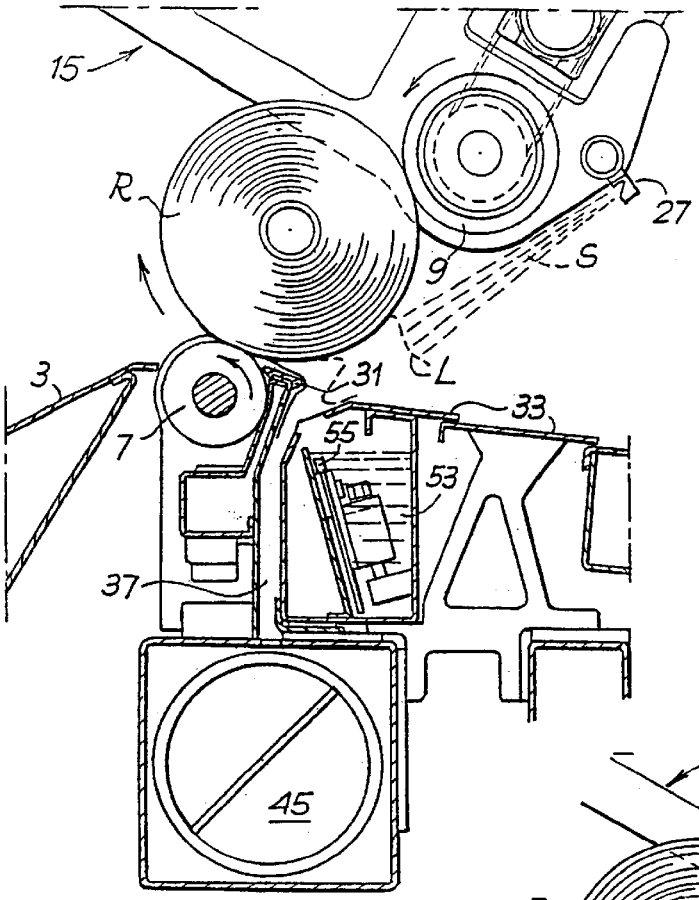
Figure 14:
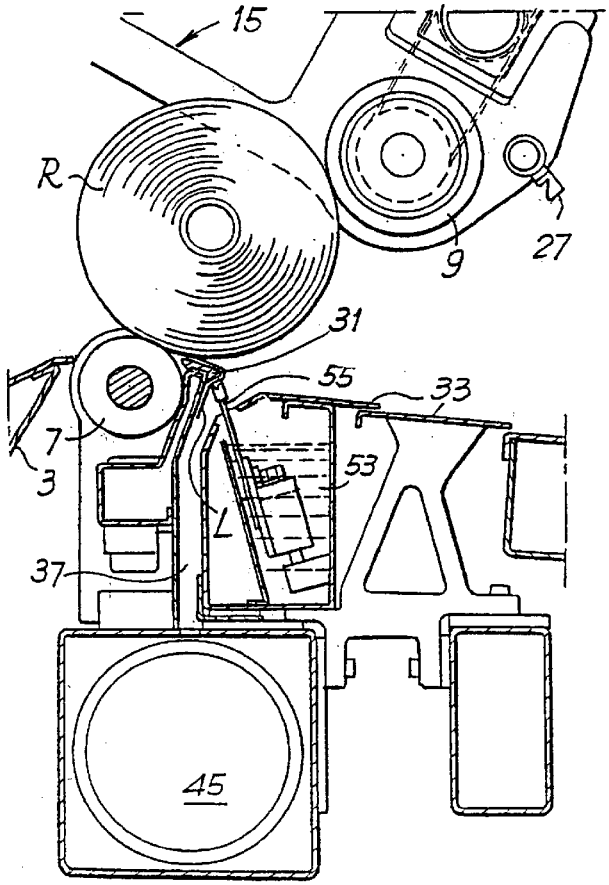

FIGS. 12, 13 and 14 show a third operating mode of the device according to the invention, which in this case has been equipped with the section bar 31 mounted in the vicinity of the mouth for access to the suction recess 37. FIG. 12 shows the step involving positioning of the roll R between the rollers 7 and 9. FIG. 13 shows the step involving positioning of the tail edge L, similar to the step shown in FIG. 4. The presence of the section bar 31, however, ensures that the tail edge L rests on said section bar and is retained against the surface of the section bar by means of the sucking action through the holes 47. During the next step shown in FIG. 14, the movable dispensing element is raised until it comes into contact with the internal surface of the tail edge L which is resting on the section bar 31. Once the glue has been applied, the movable dispensing element 55 is retracted, the tail edge L is wound up by rotating the two rollers 7 and 9 at the same angular speed and the roll is then unloaded by stopping the rollers 7 and continuing to rotate the roller 9 or in any case by modifying the peripheral speed of one roller with respect to the other one.

Alterative, unloading of the roll R may be performed without winding up beforehand the tail edge L or by performing only partial winding-up. In this case, sealing is performed during rolling of the roll R on the slideway 33 if the latter is sufficiently long with respect to the diameter of the roller. The same sealing method may be used also in the operating mode according to FIGS. 2 to 8.

It is understood that the drawing shows only one possible embodiment of the invention, the configurations and arrangements of which may be varied without departing from the scope of the idea on which the invention is based. The presence of any reference numbers in the claims is merely intended to facilitate reading thereof with reference to the preceding description and the accompanying drawings and does not limit the protective scope of the claims.

What is claimed is:

1. A device for gluing a tail edge of a roll of wound web material, comprising: a feed path for said roll; along said path a station for unwinding and positioning the tail edge of the roll; in said unwinding and positioning station a first movable member and a second movable member which make contact with said roll during unwinding and positioning of the tail edge of the roll and which define a roll position in which unwinding and positioning of the tail edge is performed, the feed path extending between said first movable member and said second movable member and passing through a nip defined therebetween; a glue dispenser comprising a glue reservoir and a dispensing element which is movable along a dispensing path and which is immersed in glue and, moving upwards, dispenses glue for gluing of the tail edge; wherein said dispensing path and said first movable member and said second movable member are positioned so that the dispensing path intersects a surface of the roll which is in a condition positioned in contact with said first movable member and said second movable member.

2. Device according to claim 1, wherein said first movable member and said second movable member move away from each other so as to allow said roll to pass through.

3. Device according to claim 1 or 2, wherein said first movable member is a rotating roller.

4. Device according to claim 3, wherein the roller forming said first movable member and a roller forming said second movable member are arranged, respectively, upstream and downstream of an access mouth of a suction recess, with respect to a direction of feeding of the roll along said feed path.

5. Device according to claim 1 or 2, wherein said second movable member is a rotating roller.

6. Device according to claim 1, wherein said second movable member is mounted on an oscillating group.

7. Device according to claim 6, wherein said oscillating group comprises weight balancing means.

8. Device according to claim 1, wherein said dispensing path is a path at least partially rectilinear and inclined with respect to the vertical.

9. Device according to claim 1, wherein downstream of said first movable member, along the feed path, there is arranged a suction recess extending downwards underneath said path, with an access mouth emerging on said path.

10. Device according to claim 9, further comprising means for arranging, in a vicinity of said access mouth, a section bar for supporting the tail edge of the roll, said section bar intersecting the dispensing path.

11. Device according to claim 10, further comprising a support and members for fixing said section bar on said support.

12. Device according to claim 9, wherein said suction recess and said dispensing path converge, the dispensing element being movable so as to intersect the access mouth of the suction recess.

13. Device according to claim 9, wherein said suction recess has a bottom, a first side wall arranged upstream and a second side wall arranged downstream with respect to a direction of feeding of the roll along said feed path; wherein said bottom is provided with at least one first suction hole; and at least one second suction hole is formed in said first side wall.

14. Device according to claim 13, wherein means are provided for interrupting sucking action through said at least one first suction hole, while keeping active sucking action through said at least one second suction hole.

15. Device according to at least claim 9, wherein said first movable member is arranged upstream of the access mouth of the suction recess with respect to a direction of feeding of the roll and wherein said second movable member is arranged at least partially downstream of said access mouth.

16. A device for gluing a tail edge of a roll of wound web material, comprising: a feed path for said roll; along said path a station for unwinding and positioning the tail edge of the roll; in said unwinding and positioning station, a first movable member and a second movable member making contact with said roll so as to unwind and position the tail edge thereof; a glue dispenser comprising a glue reservoir and a dispensing element which is movable along a dispensing path and which is immersed in glue and, moving upwards, dispenses glue for gluing of the tail edge; and support section bar on which the tail edge of the roll is rested, said dispensing path intercepting said section bar so as to apply the glue onto a surface of the tail edge which, by means of subsequent winding-up, comes into contact with a roll surface.

17. Device according to claim 16, wherein said section bar is removable.

18. Device according to claim 16 or 17, wherein said section bar is positioned in a vicinity of an access mouth of a suction recess into which a free end of a tail is sucked.

19. Device according to claim 18, wherein said suction recess extends underneath the feed path of said roll.

20. Device according to claim 16, wherein said first movable member and said second movable member are formed by a first rotating roller and a second rotating roller.

21. Device according to claim 20, wherein axes of said first roller and said second roller lie on a plane which is inclined with respect to a vertical direction and keep the roll therebetween with an axis of the roll being on one side of the plane on which the roller axes lie.

22. Device according to claim 16, wherein said first movable member and said second movable member move away from each other so as to allow the roll to pass through.

23. Device according to claim 16, wherein said first movable member and said second movable member are controlled such as to fully rewind the tail edge after glue has been applied.

24. A method for gluing a tail edge of a roll of wound web material, comprising steps of:

providing a feed path for said roll and feeding said roll along said path;

providing along said feed path a station for unwinding and positioning the tail edge of said roll of web material;

providing, in said unwinding and positioning station, at least one first movable member and one second movable member; said feed path passing through a nip between said first movable member and said second movable member;

arranging said roll of web material in said unwinding and positioning station, in contact with said first movable member and with said second movable member;

unwinding and positioning the tail edge of said web material by means of movement of said first movable member and said second movable member;

while said roll is in said unwinding and positioning station, applying glue onto a surface of the unwound tail edge which subsequently comes into contact with the roll by means of a dispensing element which removes said glue from a glue reservoir and transfers the glue onto the web material of said roll; the tail edge being subsequently wound onto the roll and caused to adhere to the roll;

feeding the roll, onto which the glue has been applied, along said feed path between said first movable member and said second movable member so as to move said roll across said nip away from the unwinding and positioning station.

25. Method according to claim 24, wherein along a dispensing path followed by said dispensing element, a section bar for supporting said tail edge is arranged; said tail edge is made to rest on said support surface; and said glue is applied onto the tail edge while supporting said tail edge on said support surface.

26. Method according to claim 25, wherein said tail edge is sucked into a suction recess extending underneath said support surface.

27. Method according to claim 24, 25 or 26, wherein, after application of said glue, the roll is unloaded from the positioning station and the tail edge is closed up and made to adhere to the roll by causing rolling of said roll on an unloading surface.

28. Method according to claim 24, 25 or 26, wherein, after application of said glue, the roll is rotated between said first movable member and said second movable member until said tail edge is wound up on said roll.

29. A method for gluing a tail edge of a roll of wound web material, comprising steps of:

providing a feed path for said roll and feeding said roll along said path;

providing a station for unwinding and positioning the tail edge of said roll of web material;

providing, in said unwinding and positioning station, at least one first movable member and one second movable member; said feed path passing through a nip between said first movable member and said second movable member;

arranging said roll of web material in said unwinding and positioning station, in contact with said first movable member and said second movable member;

unwinding and positioning the tail edge of said web material by means of movement of said first movable member and said second movable member;

applying glue onto the web material by means of a dispensing element which removes said glue from a glue reservoir and transfers the glue into a predetermined zone of a roll surface; while the roll is in contact with said first movable member and said second movable member;

feeding the roll, onto which the glue has been applied, along said feed path between said first movable member and said second movable member so as to move said roll away from the unwinding and positioning station across said nip; the tail edge being wound on the roll thus causing said tail edge to adhere to the roll.

30. Method according to claim 29 wherein, after application of said glue, the roll is unloaded and the tail edge is closed up and made to adhere to the roll by causing rolling of said roll on an unloading surface.

31. Method according to claim 29, wherein, after application of said glue, the roll is rotated between said first movable member and said second movable member until said tail edge is wound up on said roll.

* * * * *